US007726151B2

(12) United States Patent
Manole

(10) Patent No.: US 7,726,151 B2
(45) Date of Patent: Jun. 1, 2010

(54) VARIABLE COOLING LOAD REFRIGERATION CYCLE

(75) Inventor: Dan M Manole, Tecumseh, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 627 days.

(21) Appl. No.: 11/099,265

(22) Filed: Apr. 5, 2005

(65) Prior Publication Data

US 2006/0218965 A1 Oct. 5, 2006

(51) Int. Cl.
*F25B 41/00* (2006.01)

(52) U.S. Cl. ..... 62/513; 62/512; 62/525; 62/527; 62/113; 62/196.1; 165/103; 105/280; 105/283; 105/297; 122/18.1

(58) Field of Classification Search ..... 62/512, 62/513, 525, 527, 117, 113, 196.1; 105/280, 105/297, 283; 165/103; 122/18.1
See application file for complete search history.

(56) References Cited

U.S. PATENT DOCUMENTS 2,223,900 A * 12/1940 Pownall ..... 62/83
3,601,140 A * 8/1971 Hooper ..... 137/107
3,827,452 A * 8/1974 Baumgarten ..... 137/205
4,089,667 A 5/1978 Jonsson
4,199,955 A 4/1980 Jonsson
4,279,293 A 7/1981 Koump
4,377,074 A 3/1983 Jardine
4,419,865 A 12/1983 Szymaszek
4,599,870 A * 7/1986 Hebert et al. ..... 62/238.6
4,644,934 A * 2/1987 Kaus ..... 126/640
4,794,752 A 1/1989 Redderson
4,901,677 A * 2/1990 Demetri ..... 122/235.17
5,152,147 A 10/1992 Saho et al.
5,386,709 A 2/1995 Aaron
5,435,155 A 7/1995 Paradis
5,687,578 A * 11/1997 Cochran ..... 62/113
5,729,993 A 3/1998 Boiarski et al.
6,102,113 A 8/2000 Cowans
6,109,047 A 8/2000 Cowans et al.
6,145,331 A 11/2000 Tuhro
6,155,075 A * 12/2000 Hanson et al. ..... 62/512
6,161,391 A 12/2000 Trieskey
6,209,334 B1 4/2001 Cowans et al.
6,237,353 B1 5/2001 Sishtla et al.
6,327,871 B1 12/2001 Rafalovich
6,446,450 B1 9/2002 Pressler
6,523,360 B2 * 2/2003 Watanabe et al. ..... 62/204
6,644,068 B2 11/2003 Guckin
6,662,576 B1 * 12/2003 Bai ..... 62/117
6,708,511 B2 * 3/2004 Martin ..... 62/201
6,935,126 B2 * 8/2005 Ito et al. ..... 62/196.4

(Continued)

*Primary Examiner*—Frantz F Jules
*Assistant Examiner*—Azim Rahim
(74) *Attorney, Agent, or Firm*—Baker & Daniels LLP

(57) ABSTRACT

A method and apparatus for maintaining a relatively constant temperature of a working fluid in an evaporator of a refrigeration system by providing a constant volumetric displacement compressor and a heat exchanger for exchanging heat between the high pressure and low pressure portions of a refrigeration circuit to superheat, and hold substantially constant, the temperature of the refrigerant entering the compressor. In doing this, the pressure of the refrigerant in the low pressure portion of the circuit, including the evaporator, and the mass flow rate of the refrigerant remain substantially constant. As a result, the temperature of the saturated refrigerant in the evaporator remains substantially constant.

20 Claims, 3 Drawing Sheets

U.S. PATENT DOCUMENTS

2002/0035841 A1* 3/2002 Flynn ..... 62/217
2003/0126875 A1 7/2003 Enomoto
2004/0031278 A1* 2/2004 Martin ..... 62/201
2005/0120740 A1* 6/2005 Enomoto ..... 62/513

* cited by examiner

VARIABLE COOLING LOAD REFRIGERATION CYCLE

BACKGROUND OF THE INVENTION

1. Field of the Invention

The present invention relates to refrigeration systems and, more specifically, to maintaining a relatively constant temperature of refrigerant passing through an evaporator, where the evaporator is exposed to a variable thermal load.

2. Description of the Related Art

In common refrigeration systems that operate at constant evaporating temperature under variable cooling load, the refrigerant is compressed in a variable speed compressor and then cooled in a condenser. After the refrigerant is cooled in the condenser, it is passed through an expansion device, or valve, to lower its pressure. The cooled, low-pressure refrigerant then enters an evaporator where the refrigerant absorbs thermal energy as its phase changes from a liquid to a vapor. Subsequently, the refrigerant in the evaporator is drawn into the compressor and re-cycled through the circuit.

Electronic components, such as microprocessors and laser diodes, perform better and more reliably when they are maintained at a constant, low temperature. Commonly, a refrigeration system is used to cool these electronic components by placing the evaporator near the components to absorb the heat that they produce. The heat produced by and emanating from these components may change over time depending on several factors. In order to maintain these components at a relatively constant temperature, the refrigeration system must be able to increase or decrease its cooling load in response to these changes.

To adjust the cooling load provided by the refrigeration circuit, the compressor may be cycled on and off which essentially starts and stops the working fluid from flowing through the circuit. However, cycling a compressor in this manner creates difficulties in the compressor lubrication system causing premature wear. Further, turning the refrigeration cycle on and off in this manner allows the temperature of the electronic components to fluctuate substantially. These substantial temperature swings may cause soldered connections to break or cause undesired condensation on the components.

Alternatively, variable speed compressors can be used to adjust the flow rate of the working fluid in the circuit to provide a variable, yet continuous, cooling load to the evaporator. However, variable speed compressors emit a variety of frequencies during operation which may cause nearby electronic components to malfunction. Further, variable speed compressors typically require additional electronics and hardware to convert AC power to DC power, thus increasing the cost of the refrigeration system.

What is needed is a refrigeration system which is an improvement over the foregoing.

SUMMARY OF THE INVENTION

The present invention provides a method and apparatus for maintaining a relatively constant temperature of a working fluid in a evaporator of a refrigeration system. In one form of the invention, the above can be accomplished by providing a constant volumetric displacement compressor and a heat exchanger for exchanging heat between the high pressure and low pressure portions of a refrigeration circuit to superheat, and hold substantially constant, the temperature of the refrigerant entering the compressor. In doing this, the pressure of the refrigerant in the low pressure portion of the circuit, including the evaporator, and the mass flow rate of the refrigerant remain substantially constant. As a result, the temperature of the saturated refrigerant in the evaporator remains substantially constant.

In this form of the invention, when the refrigerant in the evaporator is in a two-phase state, the pressure and temperature of the refrigerant in the evaporator uniquely correspond to one another, meaning, when the pressure is constant, so is the temperature regardless of the quality of the two-phase refrigerant. The quality of a refrigerant is the percentage of the refrigerant that is in a gaseous form. By holding the pressure relatively constant throughout the low-pressure side of the refrigeration circuit, the pressure and temperature of the refrigerant in the evaporator are held constant. The pressure is held constant in the low-pressure side of the circuit by using the aforementioned heat exchanger to control the properties of the refrigerant entering the compressor and the compressor which produces a constant mass flow rate for any given pressure of the low-pressure side refrigerant. In effect, the quality of the two-phase refrigerant in the evaporator will change as the cooling demand changes, however, as long as the refrigerant in the evaporator is in a two-phase state, the temperature of the two-phase refrigerant will remain constant.

In one form of the invention, the refrigeration system includes a compressor including an inlet and an outlet, a condenser including an inlet and an outlet, the condenser inlet in fluid communication with the compressor outlet, a sub-cooler, the sub-cooler having first and second fluid passages, the first passage having an inlet and an outlet, the second passage having an inlet and an outlet, the first passage inlet in fluid communication with the condenser outlet, the first passage and the second passage in a heat exchange relationship, an expansion device having an inlet and an outlet, the expansion device inlet in fluid communication with the sub-cooler first passage outlet; and an evaporator having an inlet and an outlet, the evaporator inlet in fluid communication with the expansion device outlet; the sub-cooler second passage inlet in fluid communication with the evaporator outlet, the second passage outlet in fluid communication with the compressor inlet, the temperature of the working fluid exiting the second passage outlet being substantially constant and substantially equal to the temperature of the working fluid entering the sub-cooler first passage inlet, where the mass flow rate of the working fluid is substantially constant and the pressure of the working fluid exiting the sub-cooler second passage outlet is substantially constant, whereby the pressure and temperature of the working fluid in the evaporator are substantially constant.

In an alternate form of the invention, the refrigeration circuit includes a constant volumetric displacement compressor for maintaining a substantially constant mass flow rate of a working fluid through the refrigeration circuit, an evaporator, and means for maintaining a substantially constant temperature of the working fluid in the evaporator.

In an alternate form of the invention, a method of operating a refrigeration cycle includes the steps of compressing a working fluid to a high-pressure working fluid with a compressor, cooling the high-pressure working fluid in a condenser, transferring the high-pressure working fluid from the condenser to an expansion device through a first passage in a heat exchanger, decompressing the high-pressure working fluid to low-pressure working fluid using the expansion device, heating the low-pressure working fluid in an evaporator, transferring the low-pressure working fluid from the evaporator to the compressor through a second passage in the heat exchanger while transferring heat between the high-pressure working fluid and the low-pressure working fluid in the heat exchanger; maintaining the temperature and mass flow rate of the low-pressure working fluid exiting the sub-cooler substantially constant, thereby maintaining the pressure and temperature of the low-pressure working fluid in the evaporator substantially constant.

In an alternate form of the invention, a method of operating a refrigeration cycle includes the steps of compressing a low-pressure working fluid to a high-pressure working fluid with a compressor, cooling the high-pressure working fluid in a condenser, decompressing the high-pressure working fluid to low-pressure working fluid using an expansion device, heating the low-pressure working fluid in an evaporator, placing the evaporator and the compressor in fluid communication, wherein the pressure of the low-pressure working fluid entering the compressor and the pressure of the low-pressure working fluid in the evaporator are proportionately related, maintaining the low-pressure working fluid entering into the compressor in a superheated thermodynamic state, maintaining the temperature, mass flow rate and pressure of the low-pressure working fluid entering the compressor substantially constant, maintaining the low-pressure working fluid in the evaporator in a two-phase thermodynamic state, and maintaining the pressure of the working fluid in the evaporator substantially constant, thereby maintaining the temperature of the working fluid in the evaporator substantially constant.

During the operation of the above refrigeration systems and circuits, the refrigerant may exit the evaporator in a superheated, or nearly superheated state. Accordingly, the low-pressure superheated refrigerant may not need to receive a significant amount of heat from the high-pressure refrigerant. Thus, a bypass device may be provided so that refrigerant, in some circumstances, may circumvent the sub-cooler or heat exchanger, or a portion thereof.

In one form of the invention, a heat exchanger includes a housing, including an inlet, an outlet, a first flow path in fluid communication with the inlet and the outlet, a second flow path in fluid communication with the inlet and the outlet, and porous media in fluid communication with the inlet, the porous media expandable when exposed to a working fluid, the working fluid substantially impeded from flowing through the first flow path when the media has expanded, whereby substantially all of the working fluid will flow through the second flow path to the outlet when the working fluid is substantially impeded from flowing through the first flow path.

In an alternative form of the invention, a valve includes a housing, including at least one inlet, at least one outlet, a primary flow path in fluid communication with the at least one inlet and the at least one outlet, a bypass flow path in fluid communication with the at least one inlet and the at least one outlet, and porous media, whereby liquid portions of a working fluid entering the housing through the at least one inlet is trapped by the porous media, the porous media expanded by the liquid portions, the primary flow path substantially obstructed by the porous media when the porous media expands, whereby the fluid will flow substantially through the bypass to the at least one outlet.

BRIEF DESCRIPTION OF THE DRAWINGS

The above-mentioned and other features and objects of this invention will become more apparent and the invention itself will be better understood by reference to the following description of embodiments of the invention taken in conjunction with the accompanying drawings, wherein.

Figure 1:
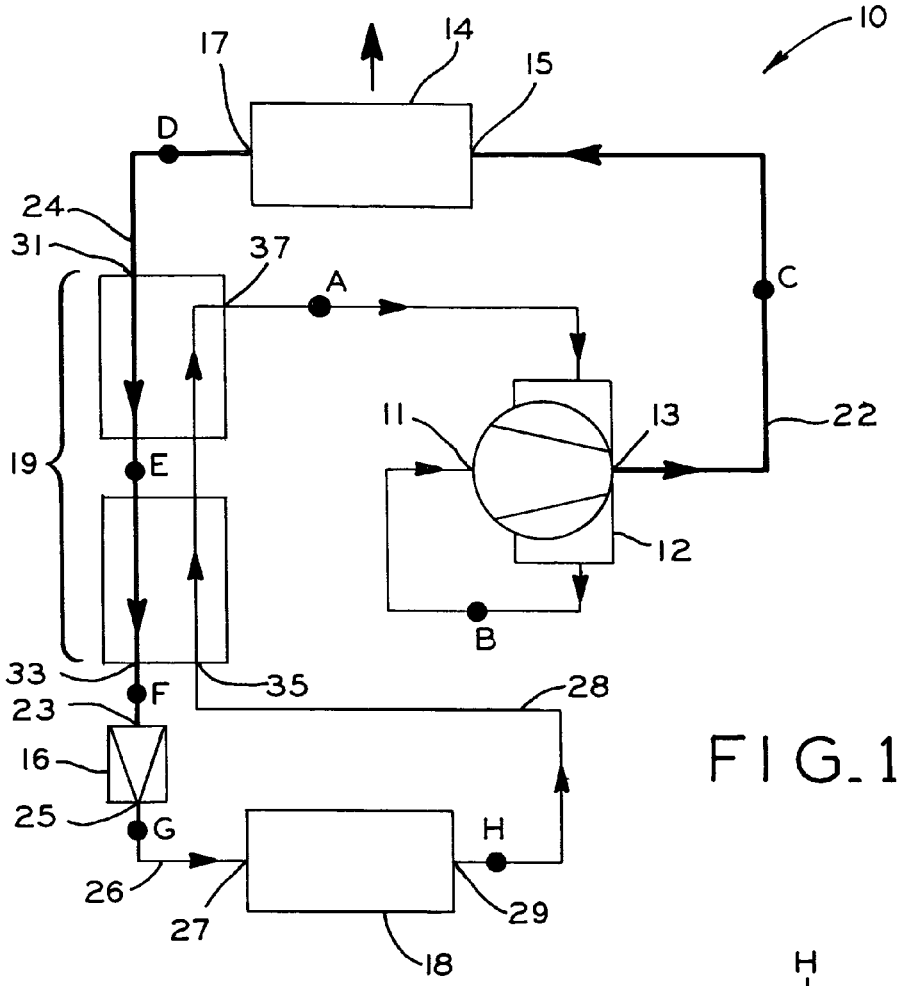
FIG. 1 is a schematic view of a refrigeration system in accordance with an embodiment of the present invention.

Corresponding reference characters indicate corresponding parts throughout the several views. Although the exemplifications set out herein illustrate embodiments of the invention, the embodiments disclosed below are not intended to be exhaustive or to be construed as limiting the scope of the invention to the precise form disclosed.

DETAILED DESCRIPTION

Included herein is a description of an exemplary refrigeration system in one form of the invention. Referring to FIG. 1, refrigeration system 10 includes, in serial order, constant volumetric displacement compressor 12, a first heat exchanger, e.g., condenser 14, an expansion device, e.g., expansion valve 16, and a second heat exchanger, e.g., evaporator 18, connected in series by fluid conduits. As is well known in the art, compressor 12 draws a refrigerant or working fluid, such as R-245fa, for example, through compressor inlet 11, compresses the refrigerant, and expels the compressed refrigerant through compressor outlet 13. R-245fa is a low density refrigerant that advantageously allows the refrigeration system to operate with a small pressure difference between the evaporator and the condenser. Compressor 12, in this form of the invention, is a constant volumetric displacement compressor and may be any positive displacement compressor including a reciprocating piston, rotary, or scroll compressor.

Figure 3:
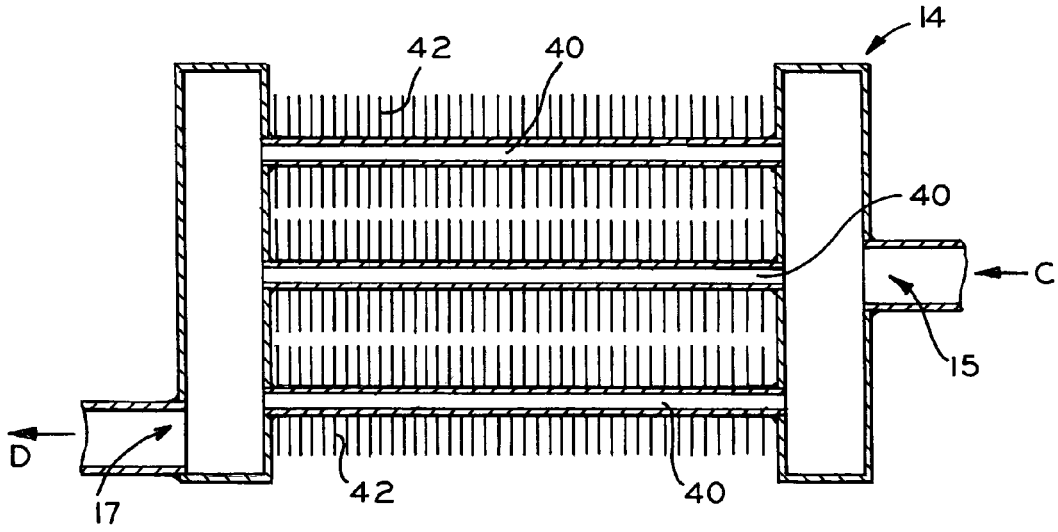
FIG. 3 is a schematic of the heat exchanger of the refrigeration system of FIG. 1.

The refrigerant expelled from compressor 12 is communicated into condenser 14 through conduit 22. Conduit 22 may be a stainless steel or brass tube or any other conduit capable of withstanding elevated pressure and temperature. The compressed refrigerant enters condenser 14 from conduit 22 through inlet 15 and exits condenser 14 through outlet 17. Between inlet 15 and outlet 17, the refrigerant passes through a series of small tubes and conduits, or micro-channels, having fins or thin plates affixed thereto for dissipating thermal energy from the refrigerant contained within. As depicted in FIG. 3, condenser 14 may be formed by a plurality of tubes 40 having radiating fins 42 mounted thereon as is well known in the art. The refrigerant within tubes 40 exchanges thermal energy with tubes 40 which, in turn, exchanges thermal energy with fins 42. A second heat exchange medium, e.g., ambient air blown over fins 42 with an air blower, absorbs thermal energy from fins 42 to thereby cool the refrigerant within tube 40. Alternatively, condenser 14 may be any type of heat exchanger including a shell-and-tube type heat exchanger where water or another refrigerant flows over the tube containing the system refrigerant.

Subsequently, the cooled, compressed refrigerant is communicated to expansion valve 16 through conduit 24. The refrigerant enters expansion valve 16 through inlet 23 and passes through an orifice into a larger chamber within expansion valve 16 allowing the refrigerant to expand and decompress. The cooled, low-pressure refrigerant exits expansion valve 16 through outlet 25 and is communicated to evaporator 18 through conduit 26. The refrigerant enters evaporator 18 from conduit 26 through inlet 27 and exits evaporator 18 through outlet 29. Similar to condenser 14, evaporator 18 may be a conventional heat exchanger where refrigerant passes between inlet 27 and outlet 29. However, unlike condenser 14 where the refrigerant is cooled, the refrigerant in evaporator 18 is heated. Evaporator 18 can be positioned near any heat emitting or conducting device, such as computer microchips or a circuit board, for example, so that the device may be cooled. Subsequently, the refrigerant exits evaporator 18 through outlet 29 and is communicated to compressor 12 through conduit 28, and the cycle described above is repeated. Although the above refrigeration process has been described by following a control mass through the refrigeration system, refrigerant is being cycled throughout the entire system as is well known in the art.

Also included in the refrigeration circuit is a third heat exchanger, sub-cooler 19. Sub-cooler 19 is a heat exchanger, or a series of heat exchangers, that exchanges thermal energy between the high pressure refrigerant that passes between condenser 14 and expansion valve 16 in conduit 24 and the low pressure refrigerant that passes between evaporator 18 and compressor 12 in conduit 28. Ultimately, sub-cooler 19 cools the high-pressure refrigerant before it passes to expansion device 16 and heats the low-pressure refrigerant before it enters compressor 12. In some embodiments, expansion device 16 is integral with sub-cooler 19. As will be discussed later, sub-cooler 19 is necessary to fix and control certain thermodynamic properties of the refrigeration cycle.

Figure 2:
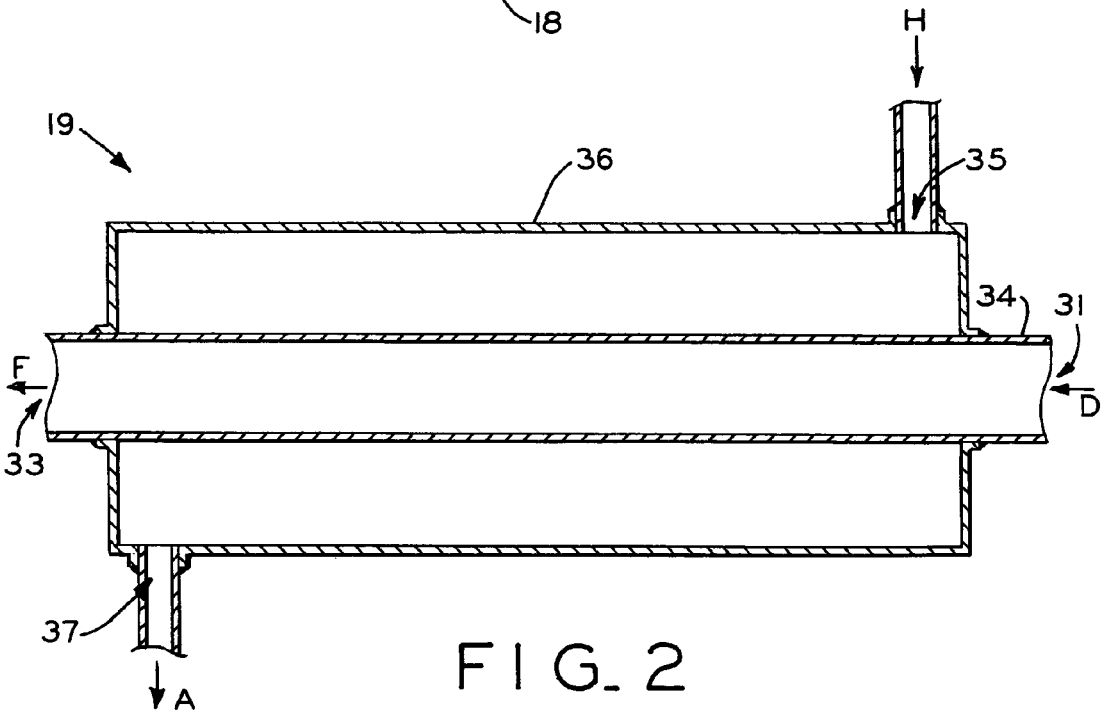
FIG. 2 is a sectional view through the sub-cooler of the refrigeration system of FIG. 1.

Sub-cooler 19 may be a tube-within-a-tube heat exchanger or any other heat exchanger. As illustrated in FIG. 2, a tube-within-a-tube heat exchanger may include small tube 34 passing through large tube 36. High pressure refrigerant passes through small tube 34 between inlet 31 and outlet 33 while, simultaneously, low pressure refrigerant passes through large tube 36 between inlet 35 and outlet 37. In this embodiment, heat is transferred from the high pressure refrigerant passing through tube 36 to the low pressure refrigerant passing through tube 34. Ultimately, if tubes 34 and 36 were long enough, the temperature of the low pressure fluid exiting sub-cooler 19 through outlet 33 would substantially equal the temperature of the high pressure fluid entering sub-cooler 19 through inlet 31. In most embodiments, the tubes are not long enough to equalize these temperatures, however, they will be substantially equalized to sufficiently effect the purposes of the invention as discussed further below.

Figure 4:
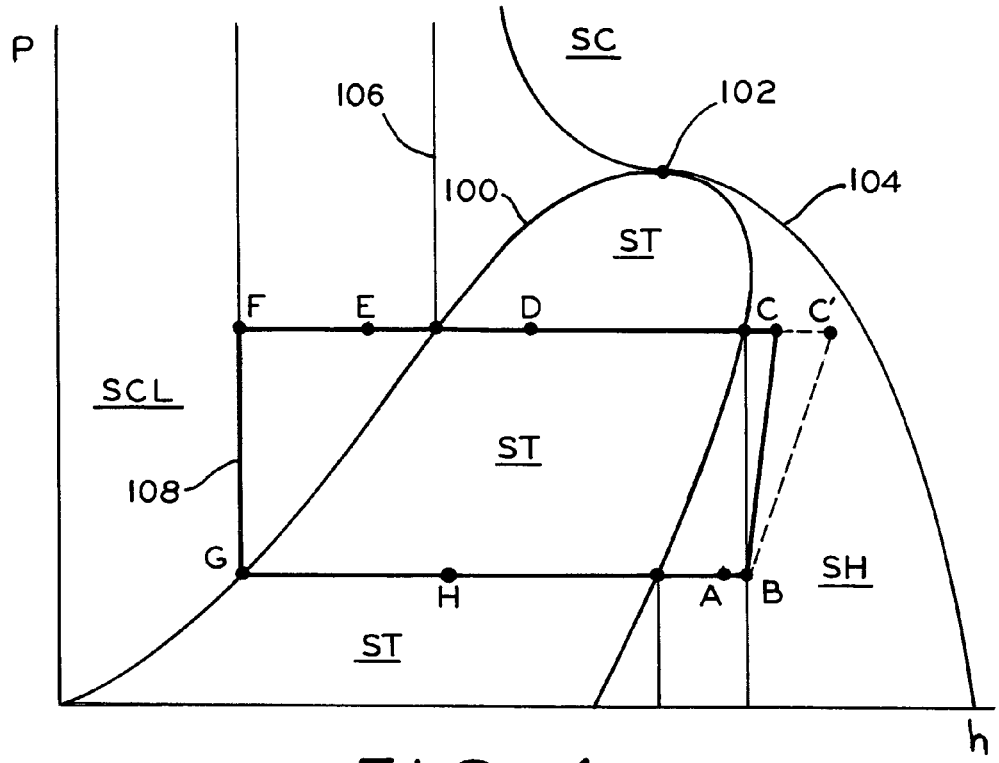
FIG. 4 is a pressure-specific enthalpy diagram for a common refrigerant which illustrates the operation of the refrigeration system of FIG. 1.

FIG. 4 illustrates the thermodynamic properties of a common refrigerant, the operation of system 10, and the relationship between the pressure and specific enthalpy of the refrigerant in various thermodynamic states. In FIG. 4, the Y-axis represents the pressure of the refrigerant and the X-axis represents the specific enthalpy of the refrigerant. Line 100 represents the liquid/vapor saturation curve of the refrigerant. Point 102 is the critical point of the refrigerant and represents the point of maximum pressure on curve 100. It is at thermodynamic state 102 when the refrigerant, at constant pressure, will instantaneously transition from liquid to gas without passing through a two-phase state. The isotherm passing through point 102, represented by line 104, has an inflection point only at point 102 where line 104 is horizontally tangent to curve 100 at point 102.

The segment of line 100 to the left of point 102 defines the liquid saturation curve while the segment of line 100 to the right of point 102 defines the vapor saturation curve. Saturation curve 100 defines the boundary between the superheated, two-phase, and sub-cooled conditions of the refrigerant. Below liquid/vapor saturation curve 100 is a two-phase region where the refrigerant exists in a combined liquid and vapor, or two-phase, state, illustrated as region ST in FIG. 4. The states of the refrigerant represented to the right of saturation curve 100 are described as superheated states where the refrigerant is entirely in a gaseous form, illustrated as region SH in FIG. 4. The states of the refrigerant represented to the left of saturation curve 100 are described as sub-cooled states where the refrigerant is entirely in a liquid form, illustrated as region SCL in FIG. 4. The states of the refrigerant represented at a pressure higher that the pressure of point 102 are described as supercritical states where the refrigerant is entirely in a supercritical form, illustrated as region SC.

The operation of system 10 is represented in FIGS. 1 and 4 by cycle ABCDEFGH. Point A represents the condition of the refrigerant at outlet 37 of sub-cooler 19. The refrigerant at point A is in a superheated state. As will be discussed in detail further below, it is a goal of this form of the invention to maintain point A in a substantially constant superheated state where the pressure and temperature of the refrigerant represented by point A is substantially constant during the operation of the refrigeration system. Movement from point A to point B in the refrigeration cycle represents the increase in temperature and energy that occurs when the refrigerant passes over the compressor housing before entering compressor inlet 11 to improve the efficiency of the refrigeration cycle. The refrigerant at point B is also in a superheated state. Movement from point B to point C represents the increase in pressure and temperature caused by the compression of the refrigerant in compressor 12. If the compression of the refrigerant were to be adiabatic, meaning an ideal compression without losses, then the discharge state would be represented by point C'. The refrigerant at point C is also in a superheated state where point C represents the state of the refrigerant at condenser inlet 15.

Movement from point C to point D represents the cooling of the superheated refrigerant in condenser 14 at an essentially constant pressure. Point D represents the refrigerant at outlet 17 of condenser 14. The refrigerant at point D is in a two-phase state. The temperature of the refrigerant at point D is substantially equal to the temperature of the ambient air passing over condenser 14, which is represented by isotherm 106 in FIG. 4. The refrigerant at point D, in certain embodiments of the present invention, may be in a sub-cooled or superheated state depending on the design of condenser 14 and the amount of energy that can be dissipated. Movement from point D to point E, and from point E to point F, represents the continued cooling of the refrigerant as it passes through sections of sub-cooler 19. In this embodiment, point E represents an intermediate step in the heat exchange process between two portions of sub-cooler 19. Point E is illustrated as a point on the saturated liquid curve, however, the refrigerant at this state may also be a wet vapor or a sub-cooled liquid. Sub-cooler 19 may include one portion or as many portions that are necessary for any particular application. The refrigerant at point F may be in a sub-cooled state and represents the refrigerant at sub-cooler outlet 33.

Figure 5:
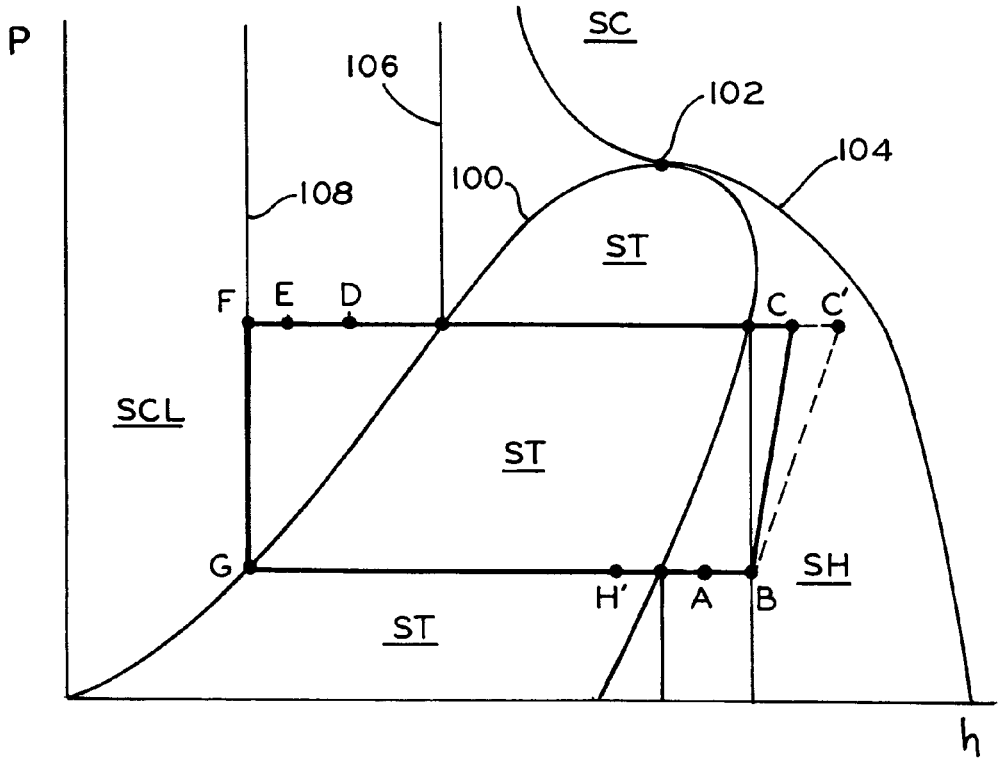
FIG. 5 is a pressure-specific enthalpy diagram demonstrating a different mode of operation of the refrigeration system of FIG. 1.

Movement from point F to point G represents the drop in refrigerant pressure as it passes through expansion valve 16. The refrigerant at point G is in a substantially saturated liquid state and represents the refrigerant at expansion valve outlet 25. Movement from point G to point H represents the energy input converting the refrigerant from a liquid phase to a vapor phase in evaporator 18. The refrigerant at point H is in a two-phase state, however, the position of point H along isotherm 108 will depend on the amount of heat absorbed by the refrigerant while in evaporator 18. As illustrated in FIG. 5 and discussed in further detail below, regardless of the position of point H, the refrigerant is heated from point H to point A in sub-cooler 19 to a superheated state. In a system used for cooling purposes, e.g., a refrigerated cabinet or air conditioning application, the length of the line GH represents the cooling capacity of the system and is coincident with isotherm 108, the saturation temperature of the refrigerant in the evaporator.

The thermodynamic cycle illustrated in FIG. 5, and represented by cycle ABCDEFGH', reflects the operation of system 10 where the refrigerant in the evaporator absorbs more thermal energy than the refrigerant in the evaporator in cycle ABCDEFGH. As a result, the specific enthalpy of the refrigerant at point H' is higher than the specific enthalpy at point H. In this embodiment, the refrigerant at point H' is almost entirely a vapor and very little additional energy is required to achieve the superheated state represented by point A. As a result, the refrigerant passing from evaporator 18 to compressor 12 through sub-cooler 19 will absorb less energy in sub-cooler 19. Regardless of the evaporator cooling load, the low-pressure vapor exits sub-cooler 19 at a substantially consistent temperature, the temperature of the ambient air passing over the condenser.

In the forms of the invention discussed above, it is a goal of the invention to maintain the temperature of the refrigerant in the evaporator substantially constant regardless of the thermal energy absorbed by the refrigerant in the evaporator. To achieve this, the thermodynamic parameters of the refrigerant entering the compressor (point A) are held substantially constant, as discussed below.

In operation, the refrigerant passing through the evaporator may be a single-component refrigerant comprised of both gas and liquid, or in other words, the refrigerant will likely be in a two-phase state. As the single-component refrigerant passing through the evaporator is in a two-phase state, the pressure and temperature of the refrigerant will uniquely correspond to one another. More specifically, if the pressure of the two-phase refrigerant is held constant, its temperature will also be held constant. However, in some embodiments, a multi-component refrigerant may be used. A multi-component refrigerant is a mixture of at least two refrigerants commonly having different boiling points. As a result, the temperature of the mixture in the evaporator may drift although one of the refrigerants is in a two-phase state. This drift, also known as the temperature glide, is the difference between the temperature at which the mixture begins to evaporate (bubble-point temperature) and the temperature at which it has completely evaporated (dew-point temperature). This drift can be minimized by using refrigerants having close but different equal boiling points. These mixtures are called azeotropic refrigerants and may be used in some embodiments of the present invention.

As discussed above, by holding the pressure of the refrigerant in the evaporator at a constant level, the temperature of the refrigerant will also be held at a constant level. To hold the pressure of the refrigerant in the evaporator constant, the pressure of the refrigerant at the compressor inlet (point A) is maintained constant. These pressures are substantially linked together because the refrigerant entering the compressor and the refrigerant in the evaporator are in fluid communication through conduit 28. To hold the pressure of the refrigerant at point A constant, and to accommodate an economical compressor designed to compress only a gas, the refrigerant at point A is maintained in a superheated state. Unlike a refrigerant in a two-phase or saturated vapor state, the pressure and the temperature of a superheated refrigerant do not uniquely correspond. In a superheated state, a refrigerant has two degrees of freedom and thus two properties of the refrigerant needs to be held constant to hold constant the other properties of the refrigerant.

The Gibbs Phase Rule can be used to determine the degrees of freedom in a system and thereby indicate the number of parameters required to control the thermodynamic state of the fluid system and states:

$$p+f=c+2$$

wherein, p=the number of phases; f=number of degrees of freedom in the system, i.e., the number of independent parameters; and c=number of fluid components in the thermodynamic system. Thus, a single phase system, such as a superheated refrigerant, will have one more degree of freedom than a two-phase system, such as a saturated refrigerant. In these embodiments, two parameters, such as temperature, pressure, specific volume, mass flow rate, or density, are required to determine the other thermodynamic properties and physical parameters of a superheated refrigerant. Similarly, to hold the physical parameters of a superheated refrigerant constant, two thermodynamic parameters of the superheated refrigerant must be held constant.

Accordingly, to hold the pressure of the refrigerant constant at the compressor inlet (point A) in the present form, both the temperature and the mass flow rate of the refrigerant must be constant. To hold the temperature of the refrigerant at the compressor inlet constant (point A), sub-cooler 19 is used to assure that the temperature of the refrigerant exiting sub-cooler 19 through outlet 37 substantially equals the temperature of the refrigerant entering sub-cooler 19 through inlet 31. As discussed above, the temperature of the refrigerant entering inlet 31 (point D) substantially equals the temperature of the ambient air passing over condenser 14 in this form of the invention. Thus, the temperature of the refrigerant at point A substantially equals the temperature of the ambient air passing over the condenser, which itself is relatively constant. With one parameter fixed, for any given mass flow rate, i.e., the second parameter, there can be only one pressure of the refrigerant at point A. Thus, for any steady state operating condition, the refrigeration system will find an equilibrium with a substantially constant mass flow rate and compressor inlet refrigerant pressure when the compressor inlet refrigerant temperature is held constant. As a result, the pressure of the refrigerant in evaporator 18 is held constant, and accordingly, the temperature of the refrigerant in evaporator 18 is thereby held constant achieving the aim of the invention.

Sub-cooler 19 can also maintain the thermodynamic parameters of the refrigerant exiting through outlet 33 (point F) in a substantially sub-cooled, or saturated liquid, state. An advantage of maintaing the refrigerant at point F in a sub-cooled state is that a saturated liquid entering evaporator 18 at point G ensures the maximum possible cooling capacity for the refrigeration system.

Although the refrigeration process described above may not be the most efficient process, it is a process that can respond to a variable thermal load while maintaing a constant evaporating temperature with a low cost refrigeration system. In one application, it is important to hold the temperature of the refrigerant in the evaporator substantially constant to avoid undercooling computer microchips, which would allow the microchips to overheat, and/or overcooling the microchips, which would allow moisture in the ambient air to condense on them possibly causing a short circuit. System 10 can also be employed for other applications.

Other forms of the invention include using a variable capacity compressor in lieu of a constant capacity compressor. A variable capacity compressor can be operated at a constant operational speed while providing a range of output displacements. An axial piston pump in combination with an adjustable swash plate is a common variable capacity compressor. A variable capacity compressor provides the refrigeration system with the flexibility to accommodate a large range of cooling load demands in the evaporator without requiring changes in operational speed, and the accompanying changes in noise.

In alternative embodiments, refrigeration system 10 may include additional features or components such as a two stage compressor mechanism that employs an intercooler to cool the intermediate pressure refrigerant between the first and second compressor stages.

As discussed above, the state of the refrigerant exiting evaporator 18 under ordinary operating conditions may range between wet vapors and a superheated gas. When the refrigerant is substantially a gas, the refrigerant will not need to absorb a large quantity of heat while passing through sub-cooler 19. Accordingly, a form of the present invention includes a liquid-responsive device for shortening the path of the refrigerant through sub-cooler 19 to reduce the thermal energy transferred to the refrigerant when the refrigerant is mostly a gas. This device may include a sensor for sensing the quality of the fluid entering into sub-cooler 19 and may electronically switch the path of the refrigerant between a longer path and a shorter path with a solenoid or any other known switching device.

Figure 6:
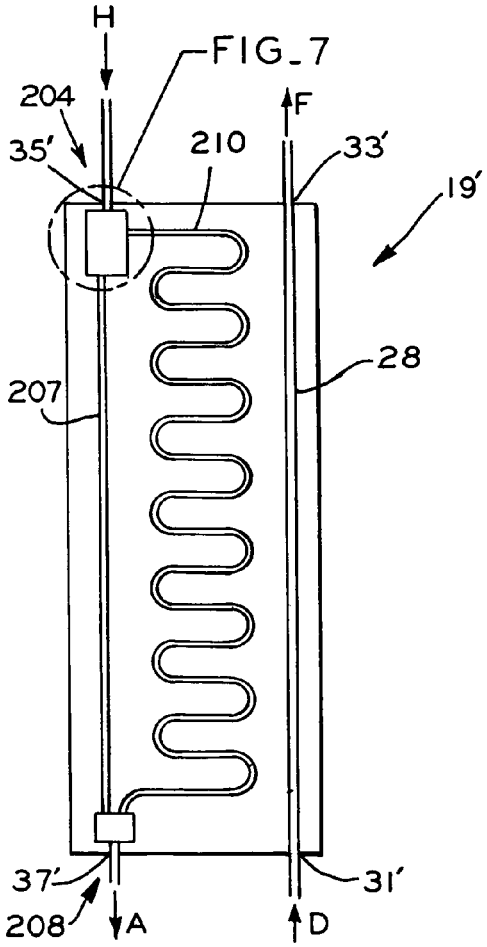
FIG. 6 is a plan view of an alternative embodiment of the sub-cooler of the refrigeration system of FIG. 1 in accordance with an embodiment of the present invention.
Figure 7:
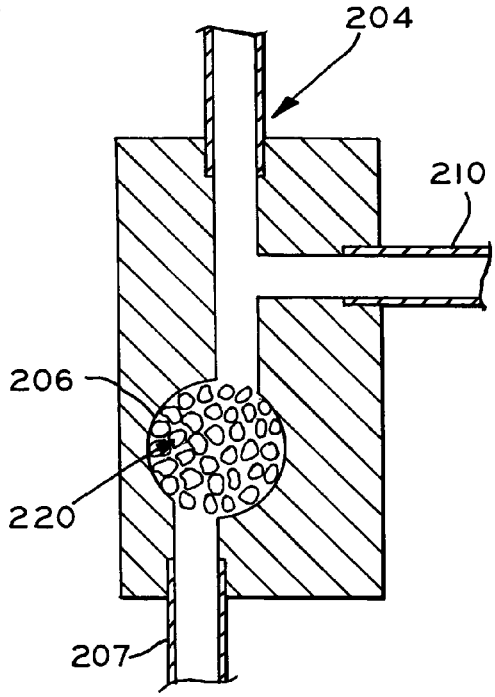
FIG. 7 is a detail view of a chamber containing porous media in the sub-cooler of FIG. 6.

Alternatively, as illustrated in FIGS. 6 and 7, sub-cooler 19' includes housing 202, a short refrigerant path, and a long refrigerant path for refrigerant to flow therethrough. The short path includes inlet 204, chamber 206, short conduit 207, and outlet 208 where inlet 204 is in fluid communication with chamber 206 and chamber 206 is in fluid communication with outlet 208 through conduit 207. The long path includes inlet 204, a relatively long, serpentine-like conduit 210, and outlet 208 where inlet 204 is in fluid communication with conduit 210 and conduit 210 is in fluid communication with outlet 208. In this embodiment, a second fluid envelops conduits 207, 210 and 28 so that thermal energy may be conducted therebetween where conduits 207 and 210 are preferably in close proximity to conduit 28. Alternatively, other heat exchangers may be used. In an alternative embodiment, similar to the heat exchanger illustrated in FIG. 2 and described above, conduits 207 and 210 would pass through a larger tube containing the high pressure refrigerant.

Porous media 220, such as a solid having pores to trap a fluid, is contained within chamber 206 such that media 220 can expand to substantially fill the volume of chamber 206 when exposed to a liquid portion of the refrigerant. Thus, when refrigerant exiting evaporator 18 and entering sub-cooler 19' is in a partially liquid state, the liquid portion of the refrigerant will be absorbed by porous media 220. As a result, porous media 220 will expand to substantially block the flow of the refrigerant through chamber 206 and a large portion of the refrigerant will flow through conduit 210. Conduit 210 comprises an extended path where the low-pressure refrigerant contained therein is exposed to the thermal energy of the high-pressure refrigerant passing through conduit 24 for a longer period of time than if the refrigerant had passed through shorter conduit 207. As a result of passing through conduit 210, in this form of the invention, the refrigerant will become superheated to the state represented by point A. Alternatively, when the refrigerant enters into sub-cooler 19' in a mostly gaseous state, the porous media will not substantially expand and the refrigerant will be able to pass through chamber 206 and shorter conduit 207. In this condition, the refrigerant does not require as much thermal energy to achieve the state represented by point A and thus will require less exposure to the thermal energy provided by sub-cooler 19'.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A refrigeration system comprising:

a compressor including an inlet and an outlet;

a working fluid present throughout the system, the working fluid capable of being in a mixed liquid/gaseous state;

a condenser including an inlet and an outlet, said condenser inlet in fluid communication with said compressor outlet;

a sub-cooler, said sub-cooler having first and second fluid passages, said first passage having an inlet and an outlet, said second passage having an inlet and an outlet, said first passage inlet in fluid communication with said condenser outlet, said first passage and said second passage in a heat exchange relationship;

an expansion device having an inlet and an outlet, said expansion device inlet in fluid communication with said sub-cooler first passage outlet; and an evaporator having an inlet and an outlet, said evaporator inlet in fluid communication with said expansion device outlet; said sub-cooler second passage inlet in fluid communication with said evaporator outlet, said second passage outlet in fluid communication with said compressor inlet, the temperature of the working fluid at said second passage outlet being substantially constant and substantially equal to the temperature of the working fluid at said sub-cooler first passage inlet, wherein the mass flow rate of the working fluid is substantially constant and the pressure of the working fluid at said sub-cooler second passage outlet is substantially constant, whereby the pressure and temperature of the working fluid in said evaporator are substantially constant;

said sub-cooler further including:

a working fluid bypass flow passage, said bypass flow passage having a different length than said second passage, said bypass flow passage in fluid communication with said second passage inlet and outlet; and an apportioning valve fluidly connected to said sub-cooler second passage inlet, said apportioning valve further fluidly responsive to the liquid content of the working fluid connected to said second passage and said bypass flow passage.

2. The refrigeration system of claim 1, wherein the working fluid at said sub-cooler second passage outlet is in a superheated thermodynamic state.

3. The refrigeration system of claim 1, wherein ambient air cools said condenser, and wherein the temperature of the working fluid at said sub-cooler second passage outlet substantially equals the temperature of the ambient air cooling said condenser.

4. The refrigeration system of claim 1, wherein the working fluid in said evaporator is in a two-phase thermodynamic state.

5. The refrigeration system of claim 1, wherein said working fluid comprises a first refrigerant having a boiling point and a second refrigerant having a boiling point, said first refrigerant boiling point different than said second refrigerant boiling point, said first refrigerant being in a substantially liquid state while said second refrigerant is in a two-phase state.

6. The refrigeration system of claim 1, wherein the working fluid at said sub-cooler first passage outlet is in a sub-cooled thermodynamic state.

7. A refrigeration system comprising:

a compressor including an inlet and an outlet;

a working fluid present throughout the system, the working fluid capable of being in a mixed liquid/gaseous state;

a condenser including an inlet and an outlet, said condenser inlet in fluid communication with said compressor outlet;

a sub-cooler, said sub-cooler having first and second fluid passages, said first passage having an inlet and an outlet, said second passage having an inlet and an outlet, said first passage inlet in fluid communication with said condenser outlet, said first passage and said second passage in a heat exchange relationship;

an expansion device having an inlet and an outlet, said expansion device inlet in fluid communication with said sub-cooler first passage outlet; and an evaporator having an inlet and an outlet, said evaporator inlet in fluid communication with said expansion device outlet; said sub-cooler second passage inlet in fluid communication with said evaporator outlet, said second passage outlet in fluid communication with said compressor inlet, the temperature of the working fluid exiting said second passage outlet being substantially constant and substantially equal to the temperature of the working fluid entering said sub-cooler first passage inlet, wherein the mass flow rate of the working fluid is substantially constant and the pressure of the working fluid exiting said sub-cooler second passage outlet is substantially constant, whereby the pressure and temperature of the working fluid in said evaporator are substantially constant, said sub-cooler further including:

a working fluid bypass flow passage, said bypass flow passage longer than said second passage, said bypass flow passage in fluid communication with said second passage inlet and outlet; and a liquid-responsive valve apportioning the flow of working fluid through said second passage and said bypass flow passage in response to the liquid content of the working fluid, said liquid-responsive valve fluidly connected to said sub-cooler second passage inlet and to said second passage and said bypass passage.

8. The refrigeration system of claim 7, said second passage including porous media, said porous media expandable when exposed to a liquid portion of said working fluid, said second passage substantially obstructed by said expanded porous media, wherein substantially all of said working fluid passes through said bypass flow passage when said second passage is substantially obstructed.

9. The refrigeration system of claim 1, wherein said compressor is a constant volumetric displacement compressor.

10. The refrigeration system of claim 1, wherein said compressor is a variable displacement compressor.

11. A method of operating a refrigeration cycle comprising the steps of:

compressing a working fluid to a high-pressure working fluid with a compressor, said working fluid capable of being in a mixed liquid/gaseous state;

cooling said high-pressure working fluid in a condenser;

transferring said high-pressure working fluid from said condenser to an expansion device through a first passage in a heat exchanger;

decompressing said high-pressure working fluid to low-pressure working fluid using said expansion device;

heating said low-pressure working fluid in an evaporator;

transferring said low-pressure working fluid from said evaporator to said compressor through a second passage in said heat exchanger while transferring heat between said high-pressure working fluid and said low-pressure working fluid in said heat exchanger;

maintaining the temperature and mass flow rate of said low-pressure working fluid exiting said heat exchanger substantially constant, thereby maintaining the pressure and temperature of said low-pressure working fluid in said evaporator substantially constant, and further including the step of diverting at least a portion of the working fluid entering said second passage into a bypass passage as a function of whether the working fluid is in a liquid state, a gaseous state or a liquid/gaseous state, to thereby transfer more heat to said working fluid in said bypass passage than would be transferred to said working fluid in said second passage.

12. A heat exchanger, comprising:

a housing, including:

an inlet;

an outlet;

a first flow path in fluid communication with said inlet and said outlet;

a second flow path in fluid communication with said inlet and said outlet; and porous media in fluid communication with said inlet, said porous media expandable when exposed to a working fluid, said working fluid substantially impeded from flowing through said first flow path when said media has expanded, whereby substantially all of said working fluid will flow through said second flow path to said outlet when said working fluid is substantially impeded from flowing through said first flow path.

13. The heat exchanger of claim 12, said porous media expandable when exposed to a working fluid in liquid form.

14. The heat exchanger of claim 12, said first flow path including a chamber, said porous media contained within said chamber, said porous media expandable to substantially fill said chamber.

15. The heat exchanger of claim 12, said second flow path including a conduit, the length of said conduit selected to control the thermodynamic properties of said working fluid exiting said heat exchanger through said outlet.

16. The heat exchanger of claim 12, said heat exchanger further including a heat transfer fluid in said housing, said heat transfer fluid and said working fluid in a heat transfer relationship.

17. A valve, comprising:

a housing including:

at least one inlet, at least one outlet, a primary flow path in fluid communication with said at least one inlet and said at least one outlet;

a bypass flow path in fluid communication with said at least one inlet and said at least one outlet; and porous media, whereby liquid portions of a working fluid entering said housing through said at least one inlet is trapped by said porous media, said porous media expanded by said liquid portions, said primary flow path substantially obstructed by said porous media when said porous media expands, whereby said fluid will flow substantially through said bypass to said at least one outlet.

18. The valve of claim 17, said primary flow path including a chamber, said porous media contained within said chamber, said porous media expandable to substantially fill said chamber.

19. The valve of claim 17, wherein said bypass flow path includes a conduit, said conduit extending into a heat exchanger, wherein working fluid passing through said conduit is in a heat exchange relationship with said heat exchanger.

20. The heat exchanger of claim 19, wherein the length of said conduit is selected to control the thermodynamic properties of said working fluid exiting through said at least one outlet.

* * * * *